US007997028B2

(12) United States Patent
Holst

(10) Patent No.: US 7,997,028 B2
(45) Date of Patent: Aug. 16, 2011

(54) INTERNAL SWIVEL DOOR FOR COMPARTMENT OF A VEHICLE

(75) Inventor: Christian Holst, Hamburg (DE)

(73) Assignee: Airbus Deutschland GmbH, Hamburg (DE)

( * ) Notice: Subject to any disclaimer, the term of this patent is extended or adjusted under 35 U.S.C. 154(b) by 139 days.

(21) Appl. No.: 12/379,081

(22) Filed: Feb. 12, 2009

(65) Prior Publication Data

US 2009/0217593 A1 Sep. 3, 2009

Related U.S. Application Data

(60) Provisional application No. 61/032,074, filed on Feb. 28, 2008.

(51) Int. Cl.
*E05D 15/28* (2006.01)

(52) U.S. Cl. ..... 49/246; 49/247; 49/248; 49/249; 49/250; 49/252; 49/260; 49/261; 244/129.4; 244/129.5

(58) Field of Classification Search ..... 49/246–255, 49/257, 258, 260, 261, 152–156; 244/129.1, 244/129.4, 129.5
See application file for complete search history.

(56) References Cited

U.S. PATENT DOCUMENTS

| | | | | | |
|---|---|---|---|---|---|
| 529,101 | A | * | 11/1894 | Bauer | 16/80 |
| 1,368,127 | A | * | 2/1921 | Ellison | 16/361 |
| 2,019,527 | A | * | 11/1935 | Ellison | 49/252 |
| 2,051,638 | A | * | 8/1936 | Graves | 49/251 |
| 2,576,854 | A | * | 11/1951 | Peremi et al. | 49/141 |
| 2,958,089 | A | * | 11/1960 | Roehm et al. | 16/49 |
| 3,101,135 | A | * | 8/1963 | Neal et al. | 49/248 |
| 3,164,404 | A | * | 1/1965 | Arnold | 292/273 |
| 3,318,047 | A | * | 5/1967 | Carson | 49/149 |
| 3,345,777 | A | * | 10/1967 | Anderberg et al. | 49/248 |
| 3,445,963 | A | * | 5/1969 | Ingham et al. | 49/141 |
| 3,456,388 | A | * | 7/1969 | Hanson et al. | 49/252 |
| 3,675,370 | A | * | 7/1972 | Catlett | 49/253 |
| 4,286,411 | A | * | 9/1981 | Wikkerink et al. | 49/252 |
| 4,672,772 | A | * | 6/1987 | Nakamura | 49/253 |
| 4,897,962 | A | * | 2/1990 | Itoh | 49/208 |
| 5,309,676 | A | * | 5/1994 | Appelmann et al. | 49/253 |
| 5,829,508 | A | * | 11/1998 | DeBower et al. | 160/371 |

FOREIGN PATENT DOCUMENTS

| | | |
|---|---|---|
| DE | 20 2006 005 485 | 6/2006 |
| EP | 0 873 898 | 10/1998 |

* cited by examiner

*Primary Examiner* — Jerry Redman
(74) *Attorney, Agent, or Firm* — Nixon & Vanderhye P.C.

(57) ABSTRACT

An internal swivel door for an aircraft compartment. A door frame for entering the compartment includes a horizontal element and at least one door leaf which is mounted inside the door frame wherein the door leaf is turned about a vertical door rotational axis. The vertical door rotational axis is moved in parallel along a predetermined local curve. In order to take up less space during opening and closing of the door and to be able to operate the door with the least possible force, the door has a rotary sliding joint between the door leaf and the horizontal element. The door leaf has a rotational movement about a momentary rotational axis running through the rotary sliding joint wherein the momentary rotational axis is moved in parallel both in relation to the horizontal element and the door leaf.

22 Claims, 2 Drawing Sheets

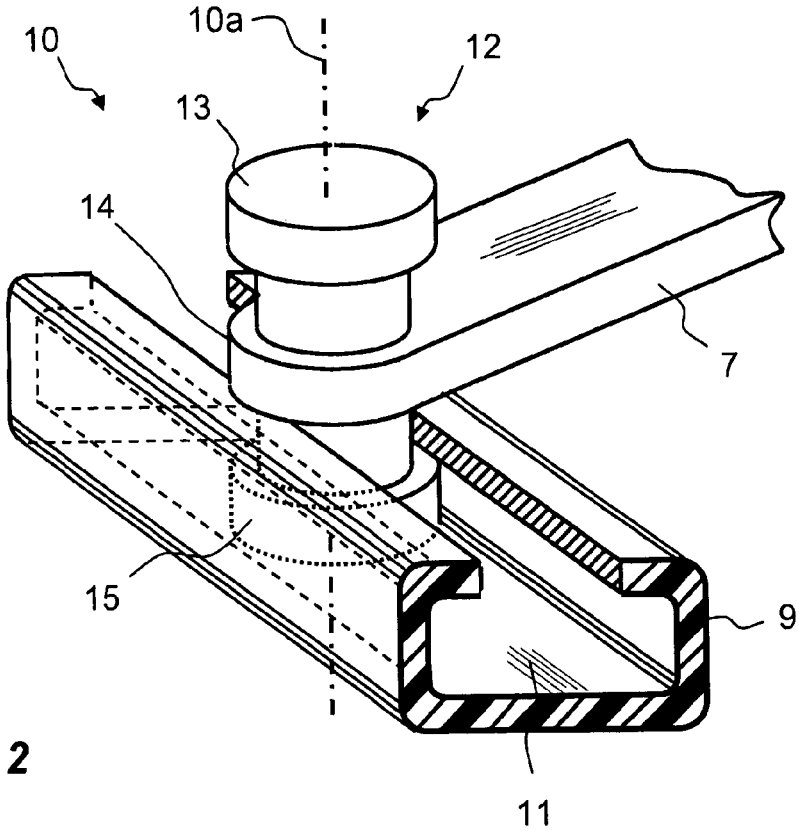
FIG. 2
FIG. 3
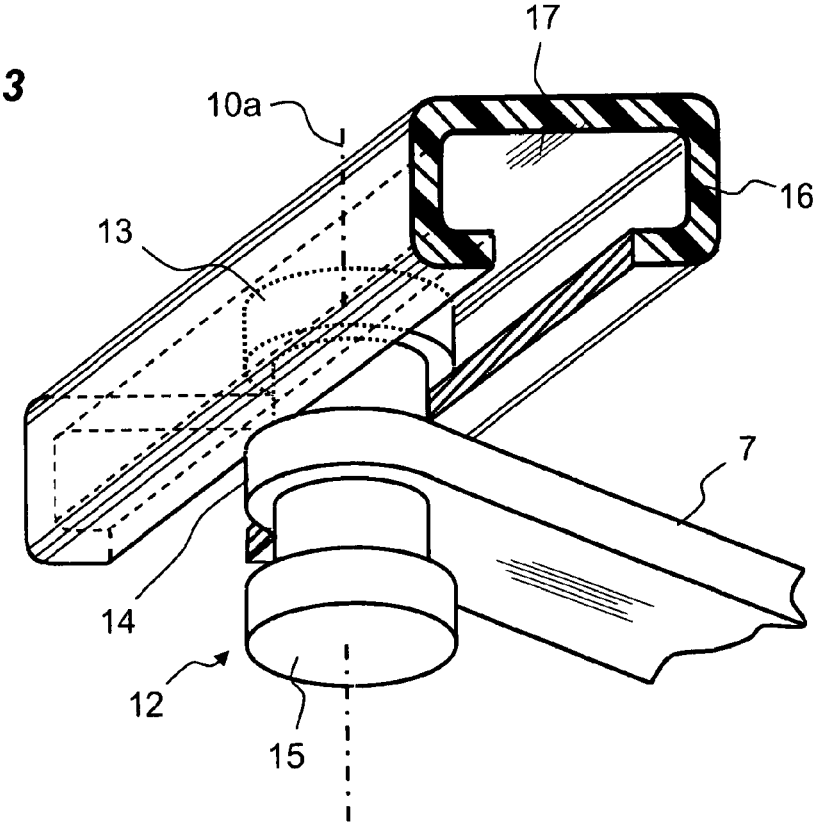

INTERNAL SWIVEL DOOR FOR COMPARTMENT OF A VEHICLE

This application claims priority to U.S. Provisional Application No. 61/032,074, filed 28 Feb. 2008, the entire contents of which is hereby incorporated by reference.

BACKGROUND OF THE INVENTION

1. Field of the Invention

The invention relates to doors for a compartment of a wide-span vehicle and more particularly but not exclusively to an internal swivel door for a compartment of an aircraft according to the preamble of claim 1.

2. Discussion of Prior Art

In aircraft the spatial conditions are relatively constricted for reasons of economy. Thus more particularly the toilet compartments and kitchen compartments are small and the gangways in front of these are very narrow. Thus there is not much space available for the doors.

Up until now swing or swivel doors were used as the doors for such installations. These have a double joint so that on opening the door the vertical rotational axis of the door leaf executes a lateral movement, i.e. the rotational axis moves on a local curve. It is thereby achieved that the door leaf projects only in part into the space in front of the door and a significant part of the door leaf always remains in the space behind the door. The advantage of this design is that the space in front of the door is only minimally obstructed by the door.

A swivel door for vehicles, more particularly buses is known from DE 20 2006 005 485 U1. In this prior art a door is shown having a door leaf whose rotational axis as the door is opened is moved parallel by way of a swivel arm on a circular path.

In EP 0 873 898 A1 a swivel door is described which is pivoted inwards by means of swivel arms which are actuated through a rotary column and is provided along a lower horizontal edge with a pivotal sealing strip.

The said doors are motor-driven doors which are driven with a precisely defined force. In the case of doors which are actuated by hand this is not the case. This means that the course of movement when opening the door by hand is not intuitive for the user and gives the feeling of being sluggish.

SUMMARY OF THE INVENTION

The object of the present invention is to provide a door for a compartment of a vehicle which on the one hand takes up little space either side of the door frame during opening and closing and which on the other hand is to be actuated with the smallest force possible wherein it gives the user the feeling that there is sufficient leverage available.

This is achieved according to the invention through the internal swivel door according to claim 1. Preferred embodiments of the invention form the subject of the dependent claims.

The invention is based on the idea of forcing the rotational movement of the door into a precisely defined path. This is achieved through a slide element which is located between the door leaf and door frame and is always entrained with the intersection point of door leaf and door frame.

The internal swivel door according to the invention for a compartment in a wide-span vehicle having a doorway frame for entering the compartment with at least one horizontal element and at least one door leaf which is mounted inside the door frame wherein the at least one door leaf is turned about a vertical door rotational axis and the vertical door rotational axis is displaced parallel along a predetermined local curve, is characterised in that a rotary sliding joint is provided between the door leaf and the at least one horizontal element so that the door leaf makes a rotational movement about a momentary rotational axis running through the rotary sliding joint wherein the momentary rotational axis is moved in parallel both in relation to the at least one horizontal element and also to the door leaf.

The internal swivel door according to the invention preferably has as a further feature or, where this is technically expedient and possible, as further features that

- the door rotational axis is guided by a guide rod;
- the rotary sliding joint is connected by a stabiliser to the guide rod;
- the rotary sliding joint comprises a bolt which is connected to the stabiliser and which is mounted rotatable and displaceable in a door leaf rail and in a door frame rail so that the stabiliser is rotatable about an axis of the bolt;
- the door leaf rail and the door frame rail are each C-rails;
- the door leaf rail and the door frame rail are made from plastics;
- the bolt is fixedly connected to the stabiliser and has clearance in the z-direction so that jamming in the door leaf rail and/or door frame rail is prevented;
- the guide rod is pretensioned by a gas compression spring between the guide rod and a side wall of the compartment in order to enable self-closing of the door;
- the guide rod has a bend and the stabiliser is attached to the guide rod in the bend;
- the rotary sliding joint is mounted above the door leaf.

One advantage of the invention over the prior art is in the very good handling of the door by the user. A further advantage is in the very small swivel area of the door.

BRIEF DESCRIPTION OF THE DRAWINGS

Further features and advantages of the invention are apparent from the following description of preferred embodiments in which reference is made to the accompanying drawings.

FIG. 2 shows diagrammatically enlarged in a perspective view the rotary sliding joint according to the invention.

FIG. 3 shows diagrammatically enlarged in a further perspective view the rotary sliding joint according to the invention.

DETAILED DISCUSSION OF EMBODIMENTS

Figure 1:
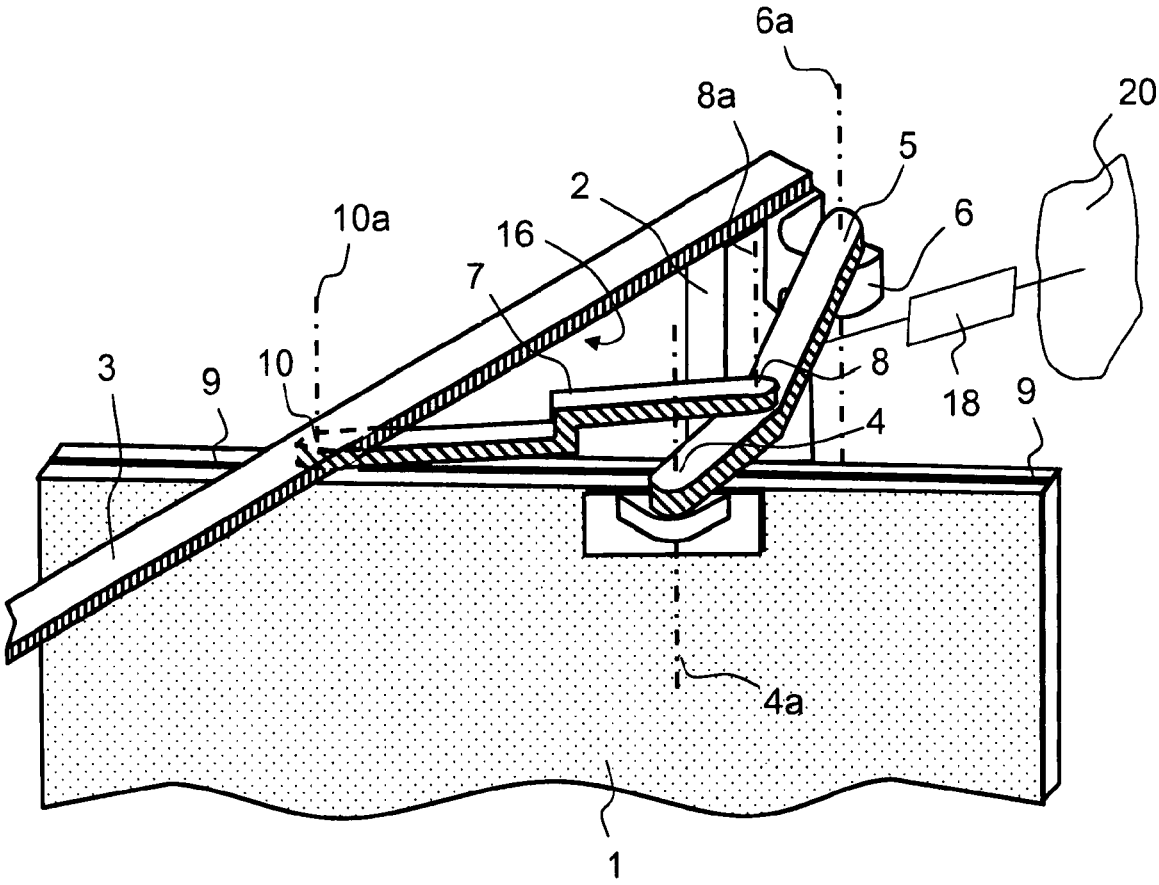
FIG. 1 shows diagrammatically in a perspective view the gearing according to the invention for adjusting the course of movement of the door.

The drawing is not to scale. The same or similarly operating elements are provided with the same reference numerals, unless stated otherwise.

FIG. 1 shows a door leaf 1 which is mounted in a door frame which is located at the entrance to a compartment (not shown). A vertical element 2 and an upper horizontal element 3 of the door frame are shown.

The door is an internal swivel door in which the rotational axis of the door leaf is displaced as the door is opened. The rotational axis of the door leaf 1 is defined by a door hinge 4, the rotational axis being marked by **4*a*. During opening the hinge 4 is moved on a circular path which is fixed by a guide rod 5 which is rotated about a guide rod hinge 6. The guide rod hinge 6** is mounted fixed on a side wall (not shown) of the compartment or on another fixedly installed unit. The rotational axes of the hinges are characterised by the letter "a" as an appendix to the relevant reference numeral.

The door leaf 1 during opening or closing is turned about the rotational axis 4*a*. Without further measures this rotation would be unspecified as one of several degrees of freedom of the door and would permit uncontrolled movement of the door. This would have inter alia the drawback that the door could slam against objects located in the vicinity and would in some circumstances damage them. Expressed in other words a correspondingly large space would have to be reserved around the door for this. Both are unacceptable in vehicles having restricted space. The movement of the door must therefore be precisely defined at any one moment in time. Furthermore the user must be given the feeling that the door offers a certain resistance if an attempt is made to deflect the door leaf out from its predetermined path.

Unlike the prior art the door leaf according to the invention is hung and guided from the horizontally aligned element 3 of the door frame wherein it is displaceable on a rail in the element 3. It is thereby reached that the momentary rotational axis of the door leaf lies within the door leaf. This momentary rotational axis is not fixed at any one point but is displaceable. For realizing this inventive idea a rail 9 is provided on the top side of the door leaf 1. Similarly in the horizontal element 3 of the door frame above the door leaf 1 there is a door frame rail which will be explained in more detail further below. A slide element runs in the door leaf rail 9 and in the door frame rail. This slide element which will be explained in detail further below fixes the course of movement of the door leaf 1 as the door is opened, i.e. defines the relationship between the opening angle of the door leaf 1 and the lateral displacement of the door leaf 1 in relation to the door frame 2, 3. In other words with this structure the rotational movement of the door leaf 1 is coupled with the linear movement along the door frame.

In order to create the linear movement of the rotational axis 4*a* away from the door frame as the door leaf 1 is opened and thus to superpose the first linear movement, a second guide rod or stabiliser 7 is inserted between the first guide rod 5 and the connecting point of the door leaf rail 9 and the door frame rail. The stabiliser 7 is attached by a stabiliser hinge 8 to the guide rod 5. The stabiliser is connected at its other end by a rotary sliding joint 10 to the door leaf rail 9 and the door frame rail. The stabiliser 7 thus ensures that the rotational axis 10*a* is displaced in parallel by the rotary sliding joint 10 in dependence on the door position both in relation to the door leaf 1 and in relation to the horizontal element 3. It is thus apparent that the rotary sliding joint 10 on the door describes a linear movement along the horizontal element 3. The rotary sliding joint 10 forms the connection between the door and the horizontal element 3. All further points of the door change their position in the plane.

The guide rod 5 is preferably designed angled, i.e. it has a bend between its two ends. The stabiliser 7 is attached in this bend. The stabiliser 7 is in turn designed stepped, i.e. one part of the stabiliser 7 is located on an upper plane and the other part of the stabiliser 7 is located on a plane underneath. With this embodiment of the guide rod 5 and the stabiliser 7 when the door is closed a very space-saving housing of the gearing is achieved.

With the construction described up until now of the gearing for the door leaf an internal swivel door is provided with which a compartment in a wide-span vehicle can be closed. On opening the door the door leaf 1 is turned about a vertical door rotational axis 4*a* and at the same time the vertical door rotational axis 4*a* is moved in parallel in a motion along a predetermined local curve.

The rotary sliding joint 10 between the door leaf 1 and the at least one horizontal element 3 ensures that the door leaf 1 makes a rotational movement about a momentary rotational axis 10*a* running through the rotary sliding joint 10 whereby the momentary rotational axis 10*a* is moved in parallel both in relation to the at least one horizontal element 3 and to the door leaf 1.

The door rotational axis 4*a* is guided for this purpose by a guide rod 5. Furthermore the rotary sliding joint 10 is connected to the guide rod 5 by a stabiliser 7.

The construction of the rotary sliding joint 10 will be explained below with reference to FIGS. 2 and 3.

FIG. 2 shows in a perspective view the rotary sliding joint 10 as is used in the door leaf rail 9. The rotary sliding joint 10 comprises a bolt 12 which is inserted in a channel 11 which is formed by the door leaf rail 9. The door leaf rail 9 is preferably a C-rail. The bolt 12 has in the illustrated embodiment an upper collar 13, a middle collar 14 and a lower collar 15. The bolt 12 is inserted by the lower collar 15 into the C-rail 11 so that it can be displaced laterally therein. So that the bolt 12 does not jam in the C-rail 11 the collar 15 preferably has such thickness, i.e. extension in the vertical or z-direction that there is sufficient clearance in the z-direction.

The bolt 12 is thus displaceable laterally in the channel 11. Furthermore both the bolt and its upper collar 13 and its lower collar 15 are shaped rotationally symmetrical so that the bolt 12 remains rotatable about its axis even when its lower collar 15 is guided into the rail 11. The stabiliser 7 is attached to its middle collar 14. Thus as explained above the bolt 12 is displaced laterally in the rail 11 by the stabiliser 7. At the same time however the bolt 12 and thus the stabiliser 7 retain their degree of rotational freedom about the axis of the bolt. In this way a coordination can be reached between the individual linear and rotational movements which will become clear below.

Whilst the lower collar 15 is inserted into the channel 11 of the door leaf rail 9 and the middle collar 14 is fixedly connected to the stabiliser 7 the upper collar 13 is inserted into the door frame rail which runs in the horizontal element 3 of the door frame so that the bolt 12 is connected to the stabiliser 7 and is mounted rotatable and displaceable in the door leaf rail 9 and in the door frame rail so that the stabiliser 7 remains rotatable about an axis of the bolt 12.

The interaction of the rotary sliding joint 10 with the door frame rail is explained below with reference to FIG. 3.

FIG. 3 shows in a perspective illustration the rotary sliding joint 10, as inserted in a door frame rail 16. The bolt 12 is inserted by its upper collar 13 into a channel 17 of the door frame rail 16. The bolt 12 is inserted by the lower collar 15 into the C-rail 11 of the door leaf rail 9. The door frame rail 16 is preferably a C-rail just like the door leaf rail 9. The bolt is thus laterally displaceable in both rails. So that the bolt 12 does not jam in the C-rail 17 the collar 13 preferably has an extension in the vertical or z-direction so that sufficient clearance arises in the z-direction. It should hereby be observed that the clearance in the z-direction must not be made too small since the bolt 12 could otherwise become jammed. The clearance in the z-direction must however also not be made so great since otherwise rattling noises or canting of the guide could occur.

The bolt 12 is thus laterally displaceable in the channel 17. Furthermore the bolt 12 is rotatable about its axis even though its lower collar 15 is guided into the rail 11 and its upper collar 13 into the C-rail 17. As explained above the bolt 12 is displaced laterally both in the rail 11 and in the rail 17 by way of the stabiliser 7. This naturally presumes that both rails can be moved relative to one another whether they are turned about the bolt or they are displaced parallel to one another.

In order to enhance the relative movement of the bolt 12 relative to one of the two rails 9 and 16 the two rails 9 and 16 are preferably made from plastics. This avoids the use of ball bearings which would incur additional costs and furthermore also add considerably to the weight.

FIGS. 2 and 3 show the embodiment of the rotary sliding joint 10 as a bolt with slidable collars 13 and 15. It is however obvious to the person skilled in the art that different variations are possible when creating the rotary sliding joint. Thus for example instead of the collars 13, 15 push slides (not shown) can be provided which are displaceable in the rails 11 and 17 respectively. Furthermore the rotational axis 10*a* of the rotary sliding joint 10 can be mounted off-set relative to the two push slides. In this case the stabiliser 7 can end in a fork (not shown) wherein the actual rotation takes place in the branch point of the fork.

From the diagrammatic illustration according to FIG. 1 it is apparent as a further feature that the guide rod 5 has a bend. This bend serves to provide optimum housing of the gearing in FIG. 1, as is apparent from the following. The stabiliser 7 is attached to the guide rod 5 in the bend. Furthermore the stabiliser 7 has a stepped design, i.e. it consists of two parts which are disposed in different planes: The upper part lies in the same plane as the horizontal element 3, the lower part lies in the same plane as the guide rod 5. With this stepped design the result is that the stabiliser 7 lies partially underneath the horizontal element 3 and partially above the guide rod 5 when the door is closed. In order to press the door leaf 1 in this position outwards against the door frame the guide rod 5 is bent forwards from the stabiliser hinge 8.

It is evident to the person skilled in the art that the above description related to the arrangement of the rotary sliding joint 10 above the door leaf 1, but that basically the same gearing can also be disposed underneath the door leaf 1. In this case FIGS. 2 and 3 need only be understood turned round mirror symmetrically.

The invention is not restricted to the embodiments illustrated. Thus the invention can be developed further particularly by pretensioning the guide rod 5 by a gas compression spring 18 between the guide rod 5 and a side wall 20 of the compartment so that the door is self-closing. Furthermore the internal swivel door can also be motor-operated.

| Reference numerals | |
|---|---|
| 1 | Door leaf |
| 2 | Door frame, vertical element |
| 3 | Door frame, horizontal element |
| 4 | Door hinge, 4a rotational axis |
| 5 | Guide rod |
| 6 | Guide rod hinge, 6a rotational axis |
| 7 | Stabiliser |
| 8 | Stabiliser hinge, 8a rotational axis |
| 9 | Door leaf rail |
| 10 | Rotary sliding joint between stabiliser, door leaf and door frame, |
| 10a | Rotational axis |
| 11 | Channel of door leaf rail |
| 12 | Bolt |
| 13 | Upper collar |
| 14 | Middle collar |
| 15 | Lower collar |
| 16 | Door frame rail |
| 17 | Channel of door frame rail |

The invention claimed is:

1. Internal swivel door for a compartment, said door including:

a door frame for entering the compartment having at least one horizontal element; and at least one door leaf which is mounted inside the door frame, wherein the at least one door leaf is turned about a vertical door rotational axis and the vertical door rotational axis is displaced parallel along a predetermined local curve, wherein a rotary sliding joint is provided between the door leaf and the at least one horizontal element so that the door leaf makes a rotational movement about a momentary rotational axis running through the rotary sliding joint, wherein the momentary rotational axis is moved in parallel both relative to the at least one horizontal element and also the door leaf.

2. Internal swivel door according to claim 1, wherein the door rotational axis is guided by a guide rod.

3. Internal swivel door according to claim 2, wherein the rotary sliding joint is connected to the guide rod by way of a stabiliser.

4. Internal swivel door according to claim 1, wherein the rotary sliding joint comprises a bolt which is connected to the stabiliser and which is mounted rotatable and displaceable in a door leaf rail and in a door frame rail so that the stabiliser is rotatable about an axis of the bolt.

5. Internal swivel door according to claim 4, wherein the door leaf rail and the door frame rail are each a C-rail.

6. Internal swivel door according to claim 4, wherein the door leaf rail and the door frame rail are made from plastics.

7. Internal swivel door according to claim 1, wherein the bolt is fixedly connected to the stabiliser and has a clearance in the z-direction so that jamming in the door leaf rail and/or door frame rail is prevented.

8. Internal swivel door according to claim 1, wherein the guide rod is pretensioned by a spring between the guide rod and a side wall of the housing of the guide rod in order to enable self closing of the door.

9. Internal swivel door according to claim 8, wherein said spring is a gas compression spring.

10. Internal swivel door according to claim 1, wherein the guide rod has a bend and the stabiliser is attached to the guide rod in the bend.

11. Internal swivel door according to claim 1, wherein the rotary sliding joint is mounted above the door leaf.

12. In an aircraft compartment, an internal swivel door, said door including:

a door frame for entering the compartment having at least one horizontal element; and at least one door leaf which is mounted inside the door frame, wherein the at least one door leaf is turned about a vertical door rotational axis and the vertical door rotational axis is displaced parallel along a predetermined local curve, wherein a rotary sliding joint is provided between the door leaf and the at least one horizontal element so that the door leaf makes a rotational movement about a momentary rotational axis running through the rotary sliding joint, wherein the momentary rotational axis is moved in parallel both relative to the at least one horizontal element and also the door leaf.

13. An internal swivel door according to claim 12, wherein the door rotational axis is guided by a guide rod.

14. An internal swivel door according to claim 13, wherein the rotary sliding joint is connected to the guide rod by way of a stabiliser.

15. An internal swivel door according to claim 12, wherein the rotary sliding joint comprises a bolt which is connected to the stabiliser and which is mounted rotatable and displaceable in a door leaf rail and in a door frame rail so that the stabiliser is rotatable about an axis of the bolt.

16. An internal swivel door according to claim 15, wherein the door leaf rail and the door frame rail are each a C-rail.

17. An internal swivel door according to claim 15, wherein the door leaf rail and the door frame rail are made from plastics.

18. An internal swivel door according to claim 12, wherein the bolt is fixedly connected to the stabiliser and has a clearance in the z-direction so that jamming in the door leaf rail and/or door frame rail is prevented.

19. An internal swivel door according to claim 12, wherein the guide rod is pretensioned by a spring between the guide rod and a side wall of the housing of the guide rod in order to enable self closing of the door.

20. An internal swivel door according to claim 19, wherein the spring is a gas compression spring.

21. An internal swivel door according to claim 12, wherein the guide rod has a bend and the stabiliser is attached to the guide rod in the bend.

22. An internal swivel door according to claim 12, wherein the rotary sliding joint is mounted above the door leaf.

* * * * *